US005567175A

United States Patent [19]

Warden et al.

[11] Patent Number: 5,567,175

[45] Date of Patent: Oct. 22, 1996

[54] PREMOLD INSERT FOR A TRANSPARENT PLUG

[75] Inventors: Harold Warden, Carmel; Sherman Cooper, Noblesville, both of Ind.

[73] Assignee: Woods Industries, Inc., Carmel, Ind.

[21] Appl. No.: 432,100

[22] Filed: May 1, 1995

[51] Int. Cl.[6] ..... H01R 3/00

[52] U.S. Cl. ..... 439/490; 29/878; 264/272.11; 439/736

[58] Field of Search ..... 439/489, 490, 439/135, 136, 910, 736, 606; 29/878; 264/272.11

[56] References Cited

U.S. PATENT DOCUMENTS

| | | | |
|---|---|---|---|
| 4,671,597 | 6/1987 | Grill | 439/488 |
| 5,207,594 | 5/1993 | Olson | 439/490 |
| 5,320,560 | 6/1994 | Fladung | 439/490 |
| 5,470,252 | 11/1995 | Fladung | 439/490 |

*Primary Examiner*—Neil Abrams
*Assistant Examiner*—Yong Kim
*Attorney, Agent, or Firm*—McAndrews, Held & Malloy, Ltd.

[57] ABSTRACT

A premold insert for securely mounting a light source within the female connector of an extension cord. The premold insert is positioned over the hot blade receiving terminal, the neutral blade receiving terminal, and the ground receiving terminal of the female receptacle. The light source is positioned within said insert such that when the insert is mounted to the terminals, the light source is secure and will not be damaged when the light-permeable plug is molded. By securing the premold insert, and hence the light source in this manner, the light source is more resilient to stress and strains. The insert acts as a shock absorber which limits the damaging effects of mechanical stresses on the light source.

14 Claims, 3 Drawing Sheets

PREMOLD INSERT FOR A TRANSPARENT PLUG

TECHNICAL FIELD

The present invention relates to an extension cord having a transparent plug with a visual light source embedded inside the plug to indicate the availability of power to the plug. More particularly, the present invention relates to an extension cord having a transparent plug with a premold insert for securing a light source within the plug, prior to the molding process of the plug, to provide a mechanically stable light source.

BACKGROUND OF THE INVENTION

For the sake of safety and convenience, it is desirable to know whether an electrical extension cord is being supplied with power. Heretofore, prior electrical connectors have used lamps of the neon variety to visually indicate that power is being supplied to the connector. U.S. Pat. No. 4,671,597 shows an electrical extension cord having a lamp which is provided at the female end of the cord for indicating the availability of power to the plug. The female end is formed from a multiple part assembly which includes an enclosure within which a lamp is connected. One side of the enclosure includes a transparent plastic window which permits the lamp to be seen from the outside of the connector. The lamp is illuminated when power is supplied to the female end of the cord. U.S. Pat. No. 5,207,594 discloses an elongated extension cord with a lamp provided in both the male and female ends of the extension cord for indicating the availability of power to the plugs.

Such extension cord receptacles are disadvantageous in several respects. Firstly, the receptacles are molded from multiple part constructions. The multiple part construction of the receptacle assemblies can fail to provide adequate protection to the electrical connections therein from stresses due to mechanical shock.

Secondly, these light sources are usually embedded in the receptacle or connectors during the molding process. The light sources are not rigidly affixed to any of the parts of the receptacle (they are usually attached by wires) and as a result are only kept in place by the molded material such as a polyvinyl plastic. Thus, when extension cords with light sources molded in the receptacles, such as these, are used in an active work area where the cord is thrown about and handled roughly, the lamp can be vibrated and damaged. Further, parts of the light source may become loose and disconnected (such as the electrical connections), or may break. If a light source stops operating, the receptacle must be discarded as the light source cannot be replaced or repaired.

SUMMARY OF THE INVENTION

In accordance with the present invention, an elongated extension cord is provided with transparent male and female plug bodies. The female plug body has a transparent premold insert secured therein, and is disposed between and around the hot and neutral terminals of the female receptacle. The premold insert has a light source secured thereon and is of such a shape to allow the female plug body to be molded therearound to form the receptacle housing. By securing the premold insert in this manner, the light source is more resilient to stresses and strains. The body of the insert acts as a shock absorber which limits the damaging effects of mechanical stresses on the electrical and mechanical connections of the light source. As the premold insert is also made of light-permeable plastic, it will not obstruct the view to the light source.

In accordance with the present invention, a premold insert is provided for inclusion into the female end of a plug prior to the molding process. The insert has three channels, which extend throughout the insert. These channels open onto the front surface of the female plug body and extend into the housing for accommodating the hot blade, neutral blade, and ground plugs of a conventional plug. The insert also has a cavity formed in its top for receiving a light source that indicates when power is available to the assembled plug.

In accordance with one embodiment of the present invention, a transparent premold insert for a transparent plug is provided which has a light source associated therewith to indicate the availability of power to an elongated extension cord. The premold insert is secured around the plug connection components prior to molding of the plug. By molding the plug around and encapsulating the premold insert, the light source is rigidly secured inside the molded plug body so that the structural integrity of the light source is improved and the longevity of the light source is improved.

In accordance with one embodiment of the present invention, an electrical connector is provided having a shock-resistible light source for displaying a power-available indication over a wide range of viewing angles by affixing the light source to a premold insert prior to molding of the plug therearound.

In accordance with one embodiment of the present invention, a premold insert for a transparent plug is provided having a lamp secured to the plug terminals and/or to the premold insert in the female end, prior to the molding of the plug.

In accordance with one embodiment of the present invention, a premold insert is provided which is constructed of a light permeable material so as to not obstruct any view to the light source and that secures a light source to the plug elements, prior to the molding process.

In accordance with the present invention, a method for constructing a transparent electrical connector with a shock resistant light source is provided.

DESCRIPTION OF THE PREFERRED EMBODIMENT

The extension cord disclosed in this application is of the type disclosed in Applicant's U.S. Pat. No. 5,320,560, which issued on Jun. 14, 1994, and is hereby incorporated by reference.

Figure 1:
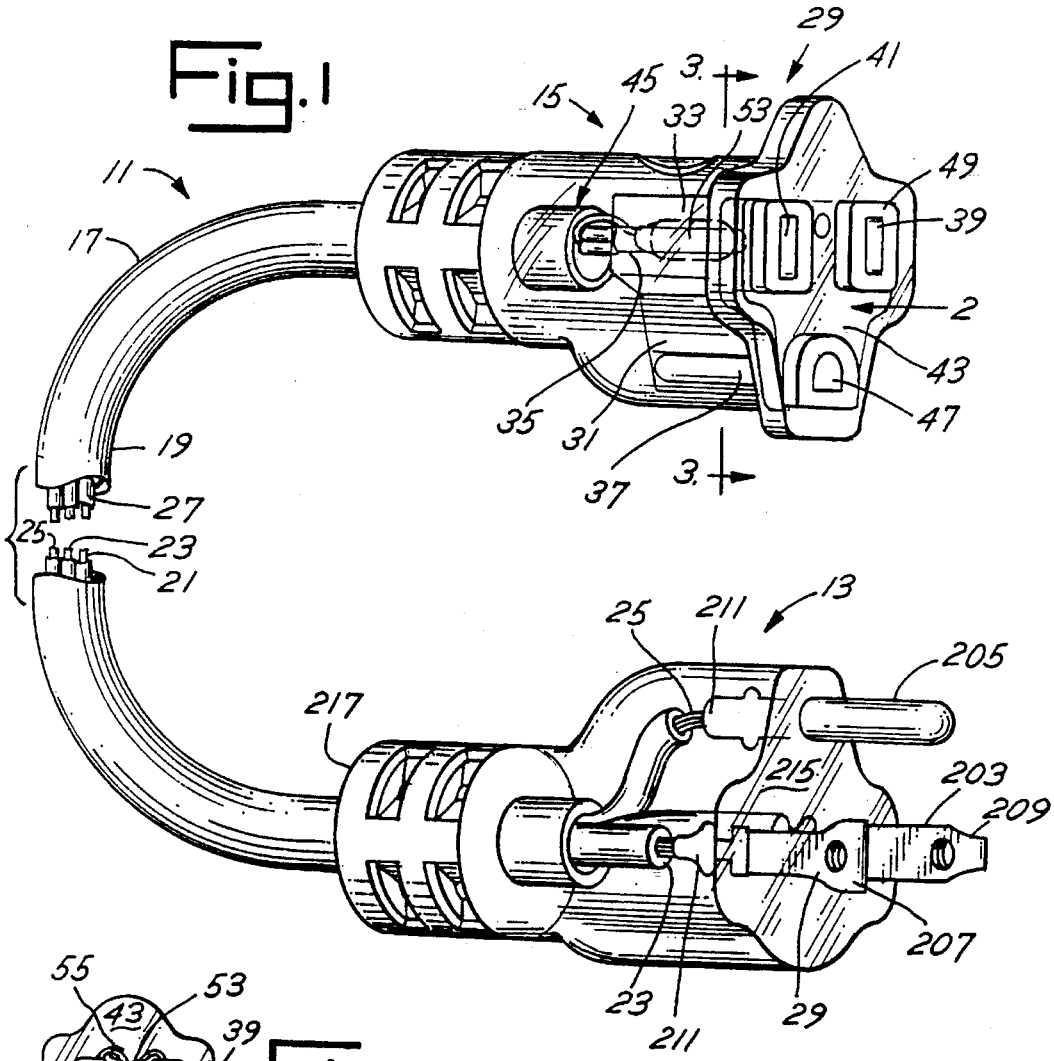
FIG. 1 is a perspective view of an extension cord having a premold insert secured in the female end of the extension cord constructed in accordance with a preferred embodiment of the present invention.

Referring to FIG. 1, an extension cord 11 includes a male electrical connector 13, a female electrical connector or receptacle 15, and an electrical cable 17 extending between the male and female connectors or receptacles 13, 15. Cable 17 comprises an outer insulating sheath 19 enclosing a "hot" or live conducting wire 21, a "neutral" conducting wire 23, and a "ground" conducting wire 25. Each of the wires 21, 23, 25 is provided with its own insulating sheath 27. Cable 17 may be, for example, a 10, 12, 14, or 16 gauge wire cable.

Female connector 15 is formed of a plastic molded housing 29 which is, for example, injection molded using conventional molding techniques. Housing 29 is a solid, light-permeable body molded from a thermoplastic, for example, polyvinyl chloride ("PVC") material and is molded around a premold insert 31, as will be discussed in detail below. Housing 29 may be formed from either transparent or translucent material. The female connector is molded from a PVC manufactured by Teknor Apex as compound #1585, the color being called "Water Clear".

Figure 2:
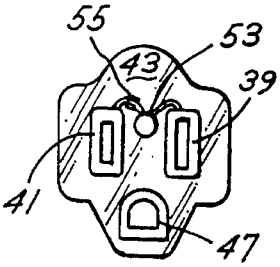
FIG. 2 is a front view of the female receptacle of the extension cord of FIG. 1 shown in the direction of the arrow 2.

Housing 29 is molded so as to encapsulate the premold insert 31, a hot blade receiving terminal 33, a neutral blade receiving terminal 35, and a ground plug receiving terminal 37. The premold insert 31, is positioned so as to encapsulate the hot, neutral, and ground receiving terminals 33, 35, 37, prior to molding. Hot and neutral blade receiving terminals 33, 35 are substantially identical and differ only with respect to their positions within the housing 29. The receiving terminals 33, 35, are made of metal and are formed of a size for receiving the blades or prong terminals of a conventional plug in electrical conducting engagement. Each receiving terminal 33, 35 is generally u-shaped having a slot for receiving a metal blade. Ground plug terminal 37 is shaped as a hollow cylinder and is generally domed shaped, as shown in FIGS. 2 and 3.

Hot and neutral blade receiving terminals 33, 35 and ground plug receiving terminal 37 are respectively connected to hot, neutral, and ground conducting wires 21, 23, 25. Blade receiving terminals 33, 35 and ground plug receiving terminal 37 each include a metal distal connecting portion (not shown), which is tightly crimped about its respective conducting wire 21, 23, 25 in order to form an electrical and mechanical connection. The three terminals 33, 35, 37 are crimped about their respective wires prior to injection molding of housing 29 which encapsulates the premold insert 31, the terminals 33, 35, 37, a portion of each conducting wire 21, 23, 25, and part of the outer sheath 19.

Figure 3:
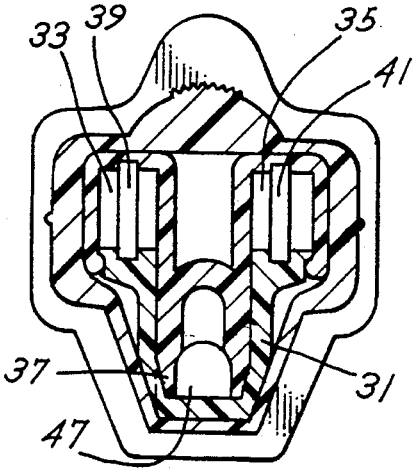
FIG. 3 is a cross-sectional view of the female receptacle of the extension cord of FIG. 1 shown in the direction of the line 3—3.

With reference to FIG. 3, the premold insert 31 has two generally rectangular passageways 39, 41 that remain after the housing 29 is molded and house the hot and neutral blade receiving terminals 33, 35. The rectangular passageways 39, 41 open onto the front surface 43 of the female plug body and extend into the mid-body region 45 of the housing 29. Additionally, the premold insert 31 has a dome-shaped passageway 47 that remains after the housing 29 is molded and houses the ground plug receiving terminal 27. The dome-shaped passageway 47 opens onto the front surface 43 and extends into the mid-body region 45 of the housing 29. The receiving terminals 33, 35, 37 and the respective passageways 39, 41, 47 are sized so as to receive a conventional 120 VAC three-prong plug. If desired, the female connector 15 may be adapted to accept only a polarized 120 VAC three prong plug. The embodiment shown is constructed for this purpose. The housing 29 preferably encapsulates a polarizing barrier 49 formed of LEXAN #141 plastic material and is shaped as a rectangular block having a rectangular aperture. The barrier 49 circumscribes passageway 39 to reinforce the boundaries of the passageway thereby preventing incorrect insertion of a polarized male plug. The polarized barrier 49 could alternatively circumscribe passageway 41. Both the passageways 39, 41 are of the same length, but the height of the passageway 39 is higher allowing insertion of the flared metal end of the "hot" blade of a polarized plug.

A visual indication of the availability of power at the female receptacle 15 is provided by a light source 53 which is encapsulated within the female receptacle 15 and rests within the premold insert 31. The premold insert 31 is preferably constructed of a transparent or translucent plastic such as a clear polycarbonate, for example, so that the light source 53 can be viewed when it is positioned within the insert 31. The light source 53 may be a subminiature red neon lamp. Such a lamp is manufactured by CHI EN. Additionally, a visual indication of the availability of power can also be made available at the male receptacle 13 by inclusion of an insert 31 therein.

The light source 53 is positioned in a cavity 57, formed in the top surface of the insert 31. The cavity 57 is comprised of a pair of sidewalls 61, a bottom wall 63, and a front wall 65. The front wall 65 is formed parallel to the front face 89 of the insert 31 and is set back therefrom. These walls 61, 63, 65 help to secure the light source 53 in the cavity 57. The front wall 65 positions the light source 53 towards the rear of the insert 31 and has a notch 69 molded therein. As the light source 53 is positioned toward the rear of the insert 31, a pair of wires 71, which extend from the light source 53 can be easily connected to two of the connecting wires 21, 23, 25 to illuminate the light source 53 when power is available to the plug 15. The wires 71 are wrapped around supports 73, formed in the back of the insert 31 and associated with each of the rectangular passageways 39, 41 and the dome-shaped passageway 47. The supports 73 are generally arcuate in shape and are adapted to receive and secure the hot, neutral and ground conducting wires 21, 23, 25. These supports 73 further help to secure the insert 31 and the light source 53 prior to the molding process. After the insert 31 and the supports 73 have been positioned over the hot, neutral, and ground plug receiving terminals 33, 35, 37, and the light source 53 has been positioned in the cavity 57, the housing 29 is then formed around these elements by conventional molding processes, as discussed above.

The light source 53 is connected in series with a resistor 55, which may be a 33K ohm resistor of one-quarter watt power rating. The series connected light source 53 and the resistor 55 are, in turn, connected between blade receiving terminals 33 and 35 for illumination of the light source 53 when power is supplied to the female connector 15 by wires 21, 23, 25. As will suggest itself, the series connected light source 53 and the resistor 55 may also be connected between the hot blade receiving terminal 33 and ground plug receiving terminal 37. As will further suggest itself, the serial order of the light source 53 and resistor 55 is a matter of choice.

Light source 53 and resistor 55 are preferably connected together by a U-shaped brass band (not shown) which is crimped into a B-shape around the ends of the light source 53 and the resistor 55. The other ends of light source 53 and the resistor 55 are preferably crimped within the separate metal connecting portions.

Figure 4:
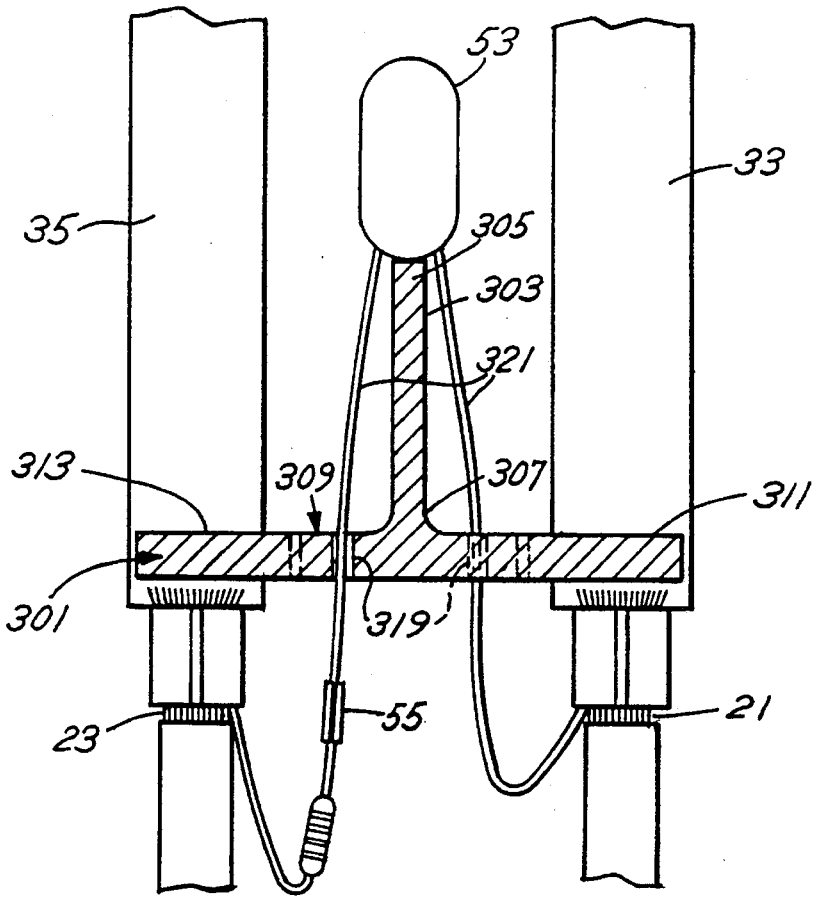
Fig. 4 (PRIOR ART)
FIG. 4 is a top view broken away of a female receptacle having a prior art premold insert molded therein.
Figure 5:
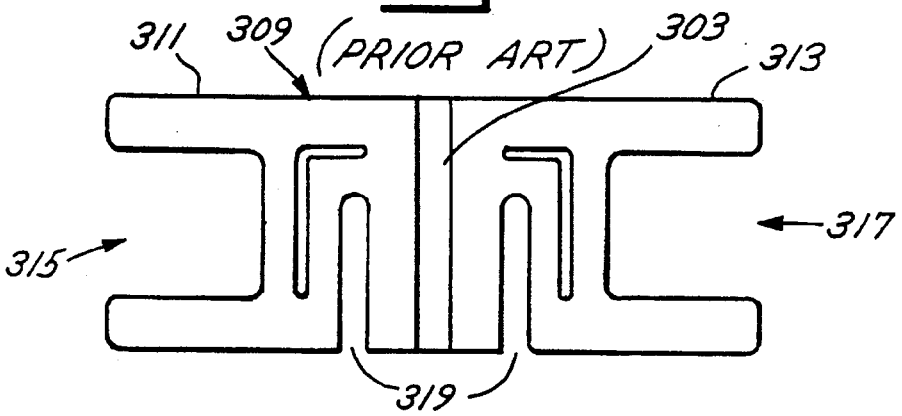
Fig. 5 (PRIOR ART)
FIG. 5 is a front view of a prior art premold insert in accordance with the insert of FIG. 4.

Other light source assemblies or premold inserts have been utilized in commercially available extension cords such as those included in extension cords sold by applicant. However, these light source assemblies or inserts have suffered similar deficiencies as did the prior plugs with light sources that did not utilize inserts, as referenced above. An example of a known light source assembly is illustrated in FIGS. 4 and 5.

The known light source assembly 301 is injection molded using conventional molding techniques. As shown in FIGS. 4 and 5, the prior art light source assembly is generally T-shaped 301 and has a visual source arm 303 for securing the light source thereon. The visual source arm 303 has a first end 305 and a second end 307 with the light source 53 being secured on the first end 305. The visual source arm 303 is attached to and extends generally perpendicular from a terminal securing plate 309 and is aligned generally parallel to the hot and neutral terminals 33, 35 of a conventional plug, as previously described. The terminal securing plate 309 has a first arm 311 and a second arm 313 which are preferably of about equal length. The first arm 311 and the second arm 313 each extend outwardly from and generally perpendicular to the second end 307 of the visual source arm 303. Each arm 311, 313 has a cavity 315, 317 which partially encompasses the hot and neutral blade receiving terminals 33, 35 to stabilize the light source assembly 301, and secure the light source 53 prior to molding. The cavity 315 formed in the first arm 311 of the securing plate 309 partially encompasses the hot blade receiving terminal 33, while the cavity 317 formed in the second arm 3 13 of the securing plate 309 partially encompasses the neutral blade receiving terminal 35. Each cavity 315, 317 is generally C-shaped.

The prior light source assembly 301 preferably has a pair of holes 319 molded therethrough to allow the wires 321 that connect the light source 53 to the connecting wires 21, 23 to pass therethrough. The prior light source assembly 301 is formed of a clear plastic such as PVC or the like and is placed over the terminals 33, 35 prior to molding of the plug in order to maintain the light source 53 in a stable position during the molding process. Because the light source 53 in these prior light source assemblies 301 was not encapsulated or protected, it was susceptible to damage during the molding process, and was also susceptible to breakage during ordinary use of the cord 13.

In accordance with the present invention, a premold insert is disclosed that overcomes these deficiencies of the prior art light source assemblies. The premold insert 31 of the present invention is a two part assembly which is secured around the hot and neutral blade receiving terminals 33, 35 prior to the molding process of the plug. As discussed, the premold insert 31 also provides a cavity 57 for placement of the light source 53 therein for prevention of any damage thereto during molding as well as prevention of any damage that may occur as a result of the everyday use of the plug. As shown in FIGS. 6, 7, 8, and 9, the premold insert 31 is a two part assembly which comprises a top portion 85 and a bottom portion 87. The two parts 85, 87 are molded so that they mate and form a unitary insert.

The bottom portion 87 has a front wall 89 with three openings 91, 93, 95 formed therein, a bottom wall 97, and a pair of opposing side walls 99, 101 which slope generally upward and outward from the bottom wall 97. The three openings 91, 93, 95 are for receiving the hot blade 33, neutral blade 35, and ground plug 37 of a conventional three way plug. The bottom portion 87 also has three channels 103, 105, 107 formed therein. The first channel 103 is for receiving the hot blade receiving terminal 33, the second channel 105 is for receiving the neutral blade receiving terminal 35, and the third channel 107 is for receiving the ground plug receiving terminal 37.

The top portion 85 has a rear wall 109, a top wall 111, and a first cavity 57 and a second cavity 127 formed in the top wall 111. The top portion 85 also has three channels 113, 115, 117 that mate with the channels 103, 105, 107 formed in the bottom portion 87 to form the passages 39, 41, 47 (discussed with reference to FIGS. 1 and 3) for entirely encapsulating the hot, neutral, and ground plug receiving terminals 33, 35, 37.

To accomplish this encapsulation, prior to molding, the bottom portion 87 of the insert 31 is positioned such that the hot blade receiving terminal 33 rests in the first channel 103, the neutral blade receiving terminal 35 rests in the second channel 105, and the ground plug receiving terminal 37 rests in the third channel 107, and then the top potion 85 of the insert is positioned to from three complete passages 39, 41, 47 that house and encapsulate the hot, neutral, and ground receiving terminals 33, 35, 37. Each of the passages 39, 41, 47 extends from the front wall 89 of the insert 31 through the interior of the insert 31 to the rear wall 109, where openings allow the connecting wires to pass therethrough (FIG. 7).

Figure 8:
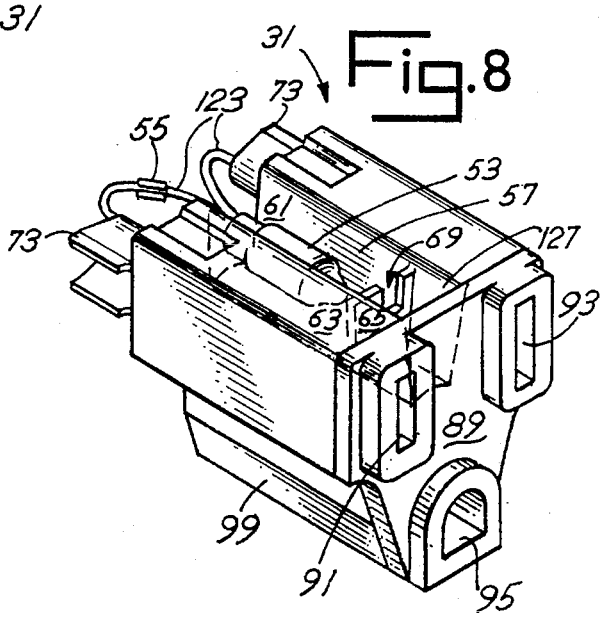
FIG. 8 is a perspective view of the premold insert constructed in accordance with the present invention.
Figure 7:
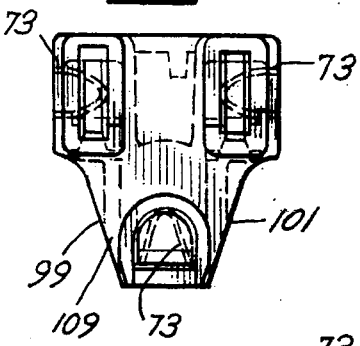
FIG. 7 is a front view of the premold insert constructed in accordance with the present invention.
Figure 9:
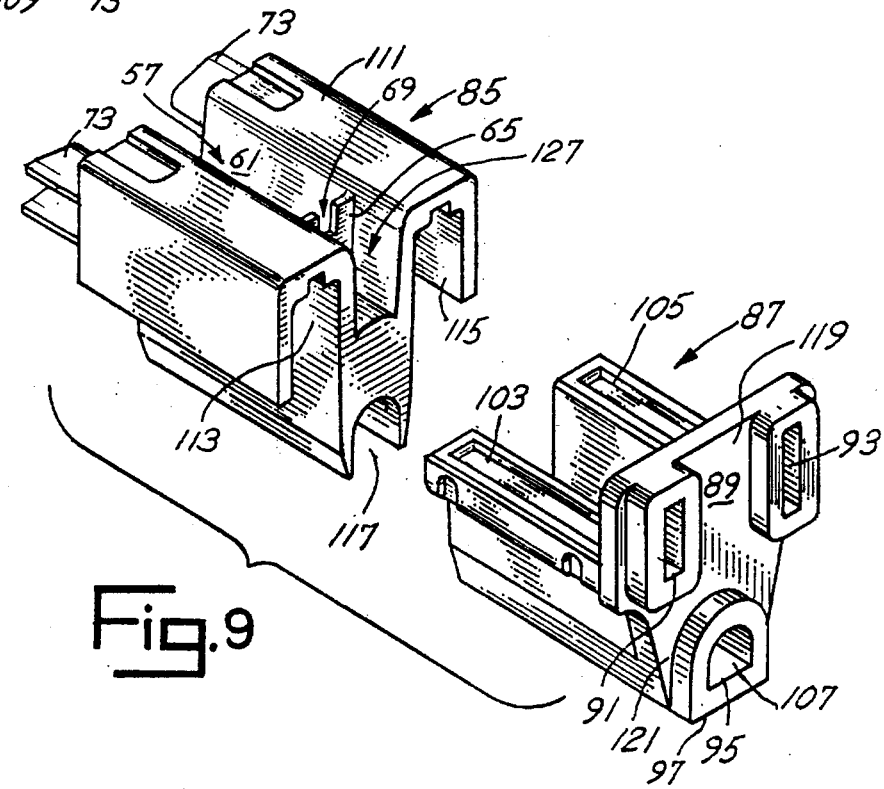
FIG. 9 is a perspective view of the components that form the premold insert in accordance with the present invention.

As best shown in FIGS. 7 and 8, the passages 39, 41, 47 are completely separate from the remainder of the insert 31. The openings 91, 93, 95 and the surrounding passages 39, 41, 47 are sized so as to receive a conventional 120 VAC three-prong plug. In the preferred embodiment, the insert 31 is generally V-shaped, when viewed from the front, in that the top wall 111 is aligned generally parallel with the bottom wall 97, and the upper portion 119 of the front wall 89 is wider than the lower portion 121 of the front wall 89 and the opposing side walls 99, 101 slope generally diagonally down from the upper portion 119 of the front wall 89 to the lower portion 121 of the front wall 89. It is to be understood, that the insert 31 can be molded in a variety of shapes, each having any number of side walls or surfaces with each wall or surface taking a variety of shapes.

Figure 6:
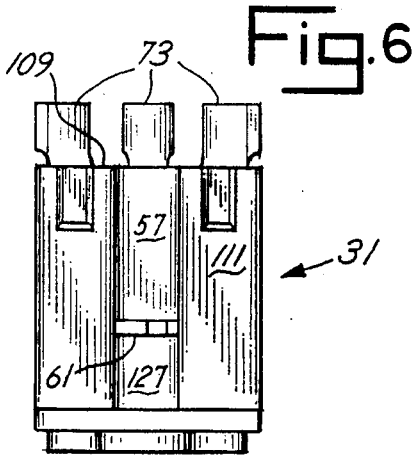
FIG. 6 is a top view of the premold insert constructed in accordance with the present invention.

As shown in FIGS. 6 and 8, the top wall 89 of the premold insert 31 has a cavity 57 for housing the light source 53. After the top and bottom portions 85, 87 of the insert 31 have been secured around the blade receiving terminals 33, 35, 37, the light source 53 is placed into the cavity 57, with the wires 123 extending off the rear of the insert. The wires 123 are extended around a pair of supports 73 which are formed on the back surface of the insert 31. As discussed, the supports are designed to engage, the hot and neutral conducting wires 21, 23 and secure the insert 31 thereon. The wires 123 extend around the supports 23 and are electrically and mechanically connected to the wires 21, 23 to illuminate the light source 53 when power is available to the plug. The plug housing 29 is then formed through known injection molding methods. As will be readily apparent, the wires 123 can alternatively be connected to wires 21, 25.

The openings 91, 93, 95 are positioned at the outer edge of mold to ensure that they open onto the front surface 43 of the molded housing 29 and to ensure that no PVC or other material will accidently get into the passages 39, 41, 47 and affect the receiving terminals 33, 35, 37. The cavities 57, 127 in the top wall 111 of the insert 31 allow the forming plastic to flow around the light source 53 and the wires 123 encapsulating them so that they are secure and will maintain mechanical integrity. When the housing 29 is molded, the premold insert 31, the receiving terminals 33, 35, 37, the light source 53, the resistor 55, the partially sheathed ends of wires 21, 23, 25, and the passages 39, 41, 47 are all entirely surrounded by and suspended within the molded housing 29. Such a molding process ensures that the polyvinyl chloride is in contact with the entire outer surface of each of the components within the housing 29 except where channels 39, 41, 47 contact receiving terminals 33, 35, 37. That is, the passages 39, 41, 47 prevent the encapsulated polyvinyl chloride from contacting the surfaces of the receiving terminals 33, 35, 37 where electrical contact will be made with a conventional plug.

Because the light source 53 has polyvinyl chloride in contact with its entire outer surface, there is an absence of oxygen surrounding the indicator and therefore there can be no combustion in that area.

Because of the soft nature of polyvinyl chloride, housing 29 serves as a cushion to absorb mechanical shock which would otherwise be transmitted to the suspended components including the light source 53. In addition, because the premold insert 31 is wedged between at least two of the contact receiving terminals, and the crimped mechanical connections are encapsulated, the insert 31 and the connections will not jostle loose by rough handling of the cord 11. Thus, premold insert 31 and hence the light source 53 are held in place by their encapsulation. Also, as the premold insert 31 is constructed of a light-permeable material, such as polycarbonate, the insert 31 cannot be seen, or if seen does not obstruct the light emitted from the light source 53.

Figure 10:
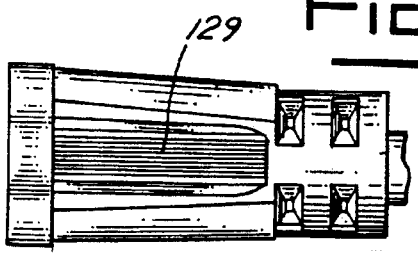
FIG. 10 is a top view of the female receptacle of the extension cord of FIG. 1.
Figure 11:
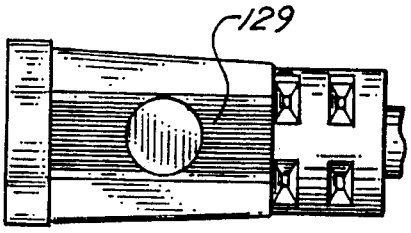
FIG. 11 is a bottom view of the female receptacle of the cord of FIG. 1.

The light source 53 is viewable from a wide range of viewing angles since housing 29 is light-permeable. Additionally, in a preferred embodiment, line indentations or grooves 129 are molded on the top surface and bottom surface of housing 29, as best seen in FIGS. 10 and 11. These grooves 129 serve to defract light emanating from light source 53, bending the light so that light will be received at all viewing angles such that receiving terminals 33, 35, 37 and the cord 11, will not block a user's view of light coming from light source 53. That is, as the user occupies a viewing line sight in which the light source 53 is hidden behind an encapsulated component within housing 29, a plurality of light defracting grooves 129 are arranged on the surface of housing 29 so that light emanating from the light source 53 is bent or refracted along another line of sight to the user. Light defracting grooves 129 are placed on the outer surface of housing 29 such that there is no single line of sight of the user in which light from light source 53 cannot reach the user's eyes.

Alternatively, grooves 129 may be molded into the top wall 111 and/or the bottom wall 97 of the insert 31 instead of the housing 29 to defract the light coming from the light source 53.

Further, where housing 29 is molded from transparent PVC and the barrier 49 is molded from a solid color material, the barrier can be seen by the user. This provides a warning to the user that the plug receptacle must receive the proper polar blade.

With reference again to FIG. 1, male connector 13 includes a hot blade 201, a neutral blade 203 and a ground plug 205. Hot blade 201 may be provided with a flared end 207 while neutral blade 203 may be provided with a tapered end 209 to adapt the connector for use as a polarized plug.

Blades 201, 203 and ground plug 205 are respectively connected to hot, neutral and ground conducting wires 21, 23, 25. Blades 201, 203 and ground plug 205 are each provided with a connecting portion 211 which is crimped about its respective wire.

Male connector body 13 is a solid, light-permeable body having a front surface 215 and a rear surface 217. Cable 17 extends through the rear surface 217 with its sheath intact. Within the body 13, the sheath has been removed thus allowing the wires 21, 23, 25 to separate and reach the connection portions of the respective blade or ground plug terminals. A small length of the individual sheath respectively surrounding each wire is removed to facilitate electrical contact between the wire and the respective connecting portion.

Male connector body 13 is injection molded as a solid body from polyvinyl chloride which entirely surrounds and encapsulates the blades 201, 203, ground plug 205, wires 21, 23, 25 and a portion of cord 17. As will suggest itself, it may be desirable to include a visual indication of the availability of power within the male connector body 13 in addition to or in lieu of the visual indicator within the female connector body 29. Thus, a premold insert 31 may be secured between the blades 201, 203 and/or series connected resistor 55 and light source 53 may be connected between the hot blade and neutral blade 201, 203 or, alternatively, between hot blade 201 and ground plug 205 within the male connector body 13.

Portions of blades 201, 203 and ground plug 205 protrude from the male connector body 13 in a direction substantially perpendicular to the plane of the front surface 215 of the male body 13 and are spaced apart within the body 13 to adapt the male connector 13 for use with a standard 120 VAC three-prong outlet.

By suspending the components within the male connector body 13 in the aforesaid fashion, the overall structural integrity of the male connector is increased since the male connector body 13 absorbs much of the mechanical shock which would otherwise be transmitted to these components including the light source 53. As is the case with the female connector body 29, cord 17 and the sheathed portions of wires 21, 23, 25 need not be included within the body 13 provided that the necessary precautions are taken to protect these components from undue mechanical stresses.

As will be apparent to those of ordinary skill in the art, numerous changes can be made to adapt the extension cord for a particular use. The bodies 29, 13 can be formed from light permeable materials other than polyvinyl chloride, however a shock absorbable material is desired. Other shapes for the connector bodies 29, 13 may also be contemplated. The shape and relative spacing of the receiving terminals and blade terminals within the respective bodies may likewise vary dependent on whether the extension cord is to be constructed for use with 120 VAC, 240 VAC, three phase, or other power schemes.

While preferred embodiments of the invention have been described hereinabove, those of ordinary skill in the art will recognize that the embodiments may be modified and altered without departing from the central spirit and scope of the invention. Thus, the preferred embodiments described hereinabove are to be considered in all respects as illustrative and not restrictive, the scope of the invention being indicated by the appended claims rather than by the foregoing description. Therefore, all changes and modifications which come within the meaning and range of equivalency of the claims are intended to be embraced herein.

What is claimed is:

1. A premold insert for insertion into the female end of a molded transparent plug comprising:

a transparent front wall;

a pair of opposing transparent side walls;

a transparent rear wall;

a first channel formed in said front wall for receiving the hot blade receiving terminal of a conventional plug;

a second channel formed in said front wall for receiving the neutral blade receiving terminal of a conventional plug;

a light source which indicates when power is available to said plug which is positioned on said insert prior to molding and which will remain positioned during said molding process to protect the mechanical and electrical integrity of said plug.

2. The premold insert of claim 1 wherein said light source is a subminiature red neon lamp.

3. The premold insert of claim 1 wherein said insert further comprises a third channel formed in said front wall of said insert for receiving the ground plug receiving terminal of a conventional plug.

4. The premold insert of claim 3 wherein said translucent or transparent material is a polyvinyl chloride.

5. The premold insert of claim 4 wherein said insert further comprises a top wall.

6. The premold insert of claim 5 wherein said top wall has a cavity formed therein for receiving said light source.

7. A premold insert for use in a light-permeable transparent plug comprising:

a first wall;

a second wall disposed generally parallel to said first wall;

a plurality of channels formed in said first wall and extending between said first wall and said second wall, said plurality of channels adapted to receive the terminals of a conventional plug; and a light source secured within said insert such that said light source will remain stable during molding of said plug around said insert and during use of said plug.

8. The premold insert of claim 7 wherein said insert further comprises a pair of opposing wall that run between and connect said first wall and said second wall.

9. The premold insert of claim 8 wherein said insert further comprises a top wall and a bottom wall.

10. The premold insert of claim 9 wherein said first wall, said second wall, said pair of opposing side wall, said top wall, and said bottom wall are all formed of a transparent or translucent material.

11. The premold insert of claim 10 wherein said top wall has a cavity formed therein for receiving said light source.

12. A method of forming a female connector for a transparent plug with a stable light source comprising the steps of:

providing a plurality of terminals for receiving the blades of a conventional plug;

providing a plurality of connecting wires which are mechanically and electrically attached to said plurality of terminals;

providing a premold insert, said premold insert including a plurality of channels and a light source positioned therein;

positioning said premold insert such that each of said plurality of terminals is encompassed by a respective one of said plurality of channels; and injecting a transparent or translucent material into a mold such that said female connector is molded and such that said terminals, said insert, said light source and a portion of said wires are encapsulated therein.

13. The method of claim 12 wherein said plurality of terminals include a hot, neutral, and ground receiving terminal.

14. The method of claim 13 further comprising the step of molding grooves into the outer surface of said female connector.

* * * * *